United States Patent [19]

Nussli et al.

[11] 4,419,603

[45] Dec. 6, 1983

[54] BIALKALINE PHOTOCATHODE HAVING INCREASED SPECTRAL SENSITIVITY AND METHOD OF MANUFACTURING SAME

[75] Inventors: Jacques Nussli; Georges J. P. Marandas; Antoine Farrayre, all of Brive, France

[73] Assignee: U.S. Philips Corporation, New York, N.Y.

[21] Appl. No.: 284,434

[22] Filed: Jul. 20, 1981

[30] Foreign Application Priority Data

Jul. 30, 1980 [FR] France ..... 80 16820

[51] Int. Cl.[3] ..... H01J 1/14; H01J 19/06

[52] U.S. Cl. ..... 313/346 R; 313/106; 313/532

[58] Field of Search ..... 313/94, 102, 346

[56] References Cited

U.S. PATENT DOCUMENTS

| | | | |
|---|---|---|---|
| 1,991,774 | 2/1935 | Spencer | 313/102 |
| 2,177,259 | 10/1939 | Keck | 313/102 X |
| 2,244,720 | 6/1941 | Massa et al. | 313/102 X |
| 2,431,401 | 11/1947 | Janes | 313/102 X |
| 2,676,282 | 4/1954 | Polkosky | 313/102 |
| 2,728,014 | 12/1955 | Stoudenheimer | 313/102 X |
| 3,697,794 | 10/1972 | Stoudenheimer | 313/94 |
| 3,697,795 | 10/1972 | Braun et al. | 313/102 |

*Primary Examiner*—Saxfield Chatmon
*Attorney, Agent, or Firm*—Norman N. Spain

[57] ABSTRACT

Photocathode of $SbK_2Cs$ destined for any electro-optical tube.

Photocathode (11) comprising a layer (12) of potassium and caesium antimonide $SbK_2Cs$ deposited on the substrate (13), also comprising a sub-layer (14) of manganese oxide, intermediate between the said substrate (13) and the said layer (12) of $SbK_2Cs$, the said sub-layer (14) of MnO improving in the red the spectral sensitivity of the layer (12) of $SbK_2Cs$.

Application notably for photomultiplier tubes used in nuclear physics.

4 Claims, 3 Drawing Figures

BIALKALINE PHOTOCATHODE HAVING INCREASED SPECTRAL SENSITIVITY AND METHOD OF MANUFACTURING SAME

The present invention relates to a photocathode comprising a layer of potassium and caesium antimonide $SbK_2Cs$ deposited on a substrate. It also relates to a method of manufacturing the said photocathode.

The photocathode according to the invention is useful in any electrooptical tube and notably photomultiplier tubes used in nuclear physics.

The alkaline photocathodes which have a layer of $SbK_2Cs$ are known in the art (see, for example, A. H. Sommer, Photoemissive Materials, John Wiley and Sons, 1968). These are produced by direct deposition of the constituents of the layer on a substrate, usually of glass. Although the photocathodes of said type usually show a satisfactory spectral response in the blue, the sensitivity, however, appears to be less than satisfactory in the red part of the visible spectrum.

It is the object of the present invention to avoid said inconvenience. It is based on the idea that the spectral response of the photocathode described in the opening paragraph could be extended towards the red by interposing between the layer of $SbK_2Cs$ and the substrate a sub-layer of a material which would decrease the sensitivity threshold of the said layer of $SbK_2Cs$.

In fact, according to the present invention, a photocathode comprising a layer of potassium and caesium antimonide ($SbK_2Cs$) deposited on a substrate is notably remarkable in that it comprises a sub-layer of manganese oxide MnO which is intermediate between the said substrate and the said layer of $SbK_2Cs$.

Experiments effected by applicants have demonstrated in fact that the presence of a sub-layer of manganese oxide MnO gives the photocathode according to the invention an increased sensitivity towards the red without affecting its spectral sensitivity in the blue.

A known method of manufacturing used to realize a photocathode such as described in the opening paragraph consists, in a first step, of evaporating potassium, generally by vacuum deposition, at a temperature of approximately 160° C., at which temperature the vapour pressure of the potassium is sufficiently high so that the said potassium can be deposited on the substrate in a sufficient quantity, after which the antimony and the caesium are in their turn deposited. However, Applicants have proved that this method applied to the manufacture of photocathodes according to the invention usually leads to photocathodes having inferior performances.

It is the object of the method according to the invention to avoid this inconvenience. It is based on the idea that the potassium could react unfortunately with the sub-layer of manganese oxide and hence that it is necessary to evaporate the potassium at a temperature such that it cannot deposit in a notable quantity on the said sub-layer of MnO.

In fact, a method of manufacturing a photocathode according to the invention is notably remarkable in fact, after the formation of the said sub-layer of MnO, in a first phase, potassium is evaporated in a space comprising the said photocathode, the temperature of the said space being maintained at a value at most equal to 100° C.

Thus, the potassium evaporated by means of vacuum deposition, for example, is deposited mainly on the walls of the said space situated in the proximity of the said vacuum deposition device without polluting the sub-layer of manganese oxide.

Then, at the end of a second phase of evaporating antimony, the temperature of the said space is brought, in a third phase, at a value substantially equal to 160° C. so as to permit the formation of potassium antimonide $SbK_3$ and, in a fourth phase, caesium is evaporated to constitute with the $SbK_3$ the said layer of $SbK_2Cs$.

The rise in the temperature of the space from 100° to 160° C. is accompanied by a sensible augmentation of the vapour pressure of the potassium which may then be deposited progressively on the photocathode and react chemically with the antimony previously deposited to give $SbK_3$. The manufacture of the photocathode in accordance with the invention is then finished by evaporation of caesium.

It is to be noted that in certain applications the said space is constituted by the envelope of the tube for which the photocathode according to the invention is destined.

From the following description with respect to the accompanying drawings, given by way of non-limiting example, the invention will be well understood.

Figure 1:
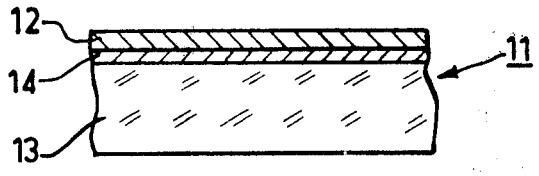
FIG. 1 is a partial sectional view of a photocathode according to the invention.

FIG. 1 is a partial sectional view of a photocathode 11 comprising a layer 12 of potassium caesium antimonide $SbK_2Cs$ deposited on a substrate 13 which, in the example of FIG. 1, is a glass. In accordance with the invention, the photocathode 11 comprises a sub-layer 14 of manganese oxide MnO which is located between between the said substrate 13 and the said layer 12 of $SbK_2Cs$, the advantage of the said sub-layer 14 of MnO being to give the layer 12 of $SbK_2Cs$ a better photoemissive power in the red part of the visible spectrum.

Figure 2:
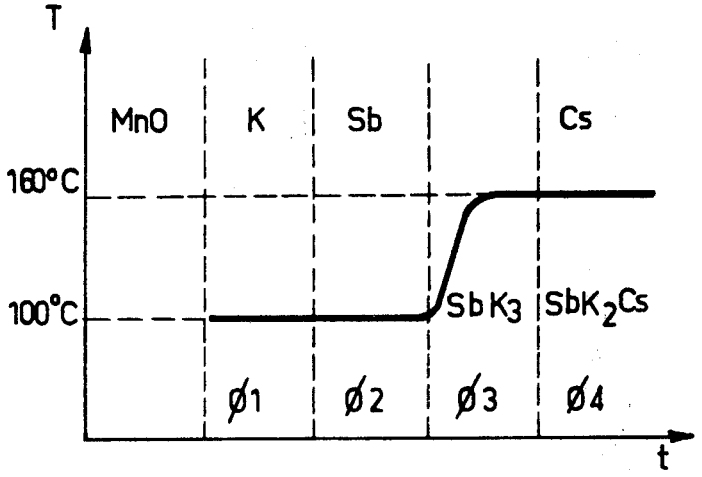
FIG. 2 is a diagram giving the evolution of the temperature during the manufacture of the photocathode of FIG. 1.

FIG. 2 gives, as a function of the time t, the evolution of the temperature T in a space comprising the photocathode in accordance with the invention, during the manufacture of the said photocathode. It should be noted with reference to FIG. 2 that, after formation of the said sub-layer of MnO, in a first phase, $\phi$1, potassium is evaporated in a space comprising the said photocathode, the temperature T of the said space being maintained at a value of 100° C. At this temperature, the vapour pressure of the potassium, produced by a vacuum deposition device, is sufficiently low in order that the said potassium can not deposit in a notable quantity on the photocathode but rather on the walls of the said space situated in the proximity of the said vacuum deposition device.

Subsequently, in a second phase $O_2$ antimony is evaporated at the end of a second phase $\phi_2$ of the temperature T of the said space then is brought, in a third phase $\phi_3$, to a value substantially equal to 160° C. so as to permit the formation of potassium antimonide $SbK_3$ and in a fourth phase $\phi_4$ caesium is evaporated to form with $SbK_3$ the said layer of $SbK_2Cs$. It should be noted that at the temperature of 160° C., the vapour pressure of the potassium becomes sufficiently high to allow the potassium to be deposited on the photocathode and react with the antimony to form $SbK_3$. The evaporation of caesium completes the formation of the said photocathode while forming with $SbK_3$ potassium caesium antimonide $SbK_2Cs$.

Figure 3:
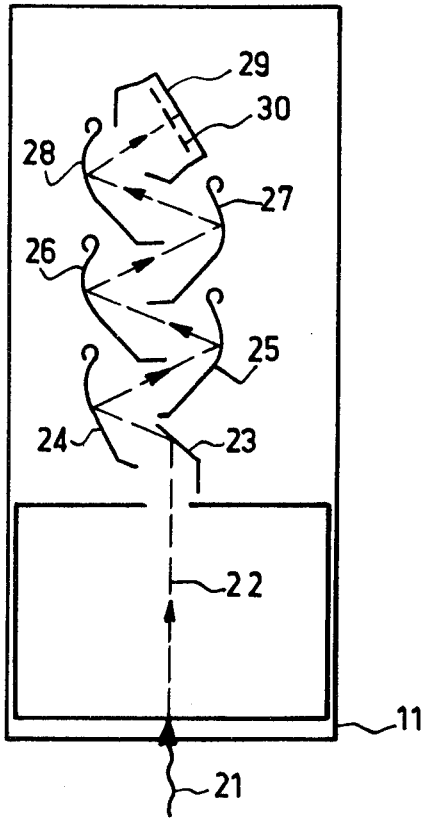
FIG. 3 is a diagrammatic sectional view of a photomultiplier provided with a photocathode analogous to that shown in FIG. 1.

FIG. 3 is a diagram of a photomultiplier comprising a photocathode in accordance with the invention. The incident light 21 impinges on the photocathode 11 which emits electrons 22. The said electrons 22 are then focused on a first dynode 23 and multiplied successively by the dynodes 23, 24, 25, 26, 27, 28, 29 and finally collected by the anode 30.

What is claimed is:

1. A photocathode comprising a layer of potassium caesium antimonide $SbK_2Cs$ deposited on a substrate characterized in that said substrate comprises a sub-layer of manganese oxide MnO in contact with said layer of potassium caesium antimonide and an inert outer layer substrate in contact with said layer of manganese oxide.

2. A photomultiplier tube comprising a photocathode as claimed in claim 1.

3. A method of manufacturing the photocathode of claim 1 wherein the sub-layer of MnO is deposited on the inert outer substrate and a layer of $SbK_2Cs$ is formed on said sub-layer of MnO characterized in that as a first phase potassium is evaporated in a space comprising said MnO deposited layer while maintaining the temperature of said space at most equal to 100° C.

4. The method of claim 3 characterized in that subsequent to the evaporation of potassium, in a second phase antimony is evaporated in said space, in the third phase the temperature of said space is raised to approximately 160° C. to cause the formation of a layer of potassium antimonide $SbK_3$ on said MnO deposited layer and in a fourth phase while maintaining the temperature of said space at approximately on 160° C. caesium is evaporated in said space thereby converting said layer of $SbK_3$ to $SbK_2Cs$.

* * * * *